US005311923A

United States Patent [19]

Cobes et al.

[11] Patent Number: 5,311,923

[45] Date of Patent: May 17, 1994

[54] SUPPORTING AND FASTENING MEANS FOR MOLD BLOCKS IN A CONTINUOUS BLOCK CASTER

[75] Inventors: John W. Cobes, Lower Burrell; S. John Pien, Export; Larry W. Cisko, Irwin, all of Pa.

[73] Assignee: Aluminum Company of America, Pittsburgh, Pa.

[21] Appl. No.: 787,618

[22] Filed: Nov. 4, 1991

[51] Int. Cl.[5] ..... B22D 11/06

[52] U.S. Cl. ..... 164/430; 164/435; 164/479

[58] Field of Search ..... 164/479, 430, 481, 427, 164/435, 431

[56] References Cited

U.S. PATENT DOCUMENTS

| | | | |
|---|---|---|---|
| 3,570,586 | 3/1971 | Lauener | 164/430 |
| 4,911,223 | 3/1990 | Sato | 164/481 |

FOREIGN PATENT DOCUMENTS

| | | | |
|---|---|---|---|
| 102715 | 12/1937 | Australia | 164/430 |
| 61-82954 | 4/1986 | Japan | 164/430 |
| 64-75152 | 3/1989 | Japan | 164/430 |
| 1-306053 | 12/1989 | Japan | 164/430 |
| 737114 | 5/1980 | U.S.S.R. | 164/430 |

*Primary Examiner*—Paula A. Bradley
*Assistant Examiner*—Rex E. Pelto
*Attorney, Agent, or Firm*—Alfred D. Lobo; David W. Pearce-Smith

[57] ABSTRACT

A continuous block caster is provided with a mold block assembly having an internal anchor pin which is insulated. One end of a support pin, many of which are used to support each block, is threaded into the anchor pin, the other end is demountably secured in a fastening member in turn fastened to a carriage block. All the fastening members except only one at the center, are y- or x-y slides, so termed because they permit lateral movement of the support pin. A stepped lock-down key which provides a camming means, allows an entire mold block assembly and supporting pin assembly to be connected and disconnected quickly from the carriage block by rotating the key. Insulating the support pin in this manner allows the planarity of a casting face to be maintained in a lateral plane within 5 mils (127 micrometers) of vertical movement. Such limited distortion does not adversely affect the planarity of the upper and lower faces of the cast slab.

11 Claims, 5 Drawing Sheets

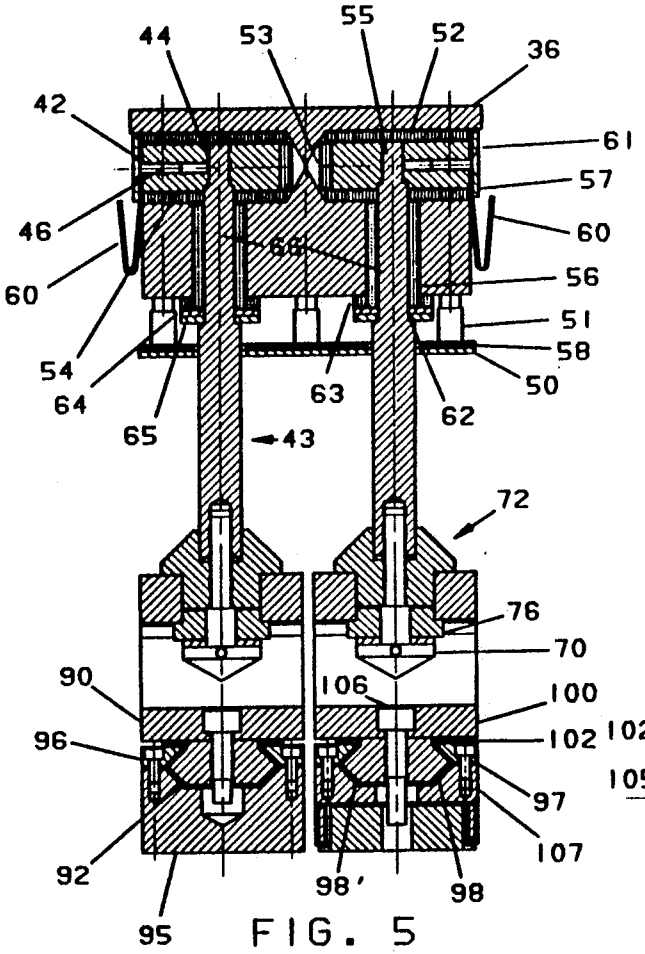
FIG. 5
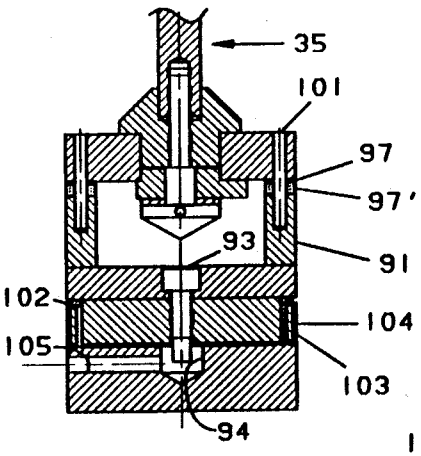
FIG. 6
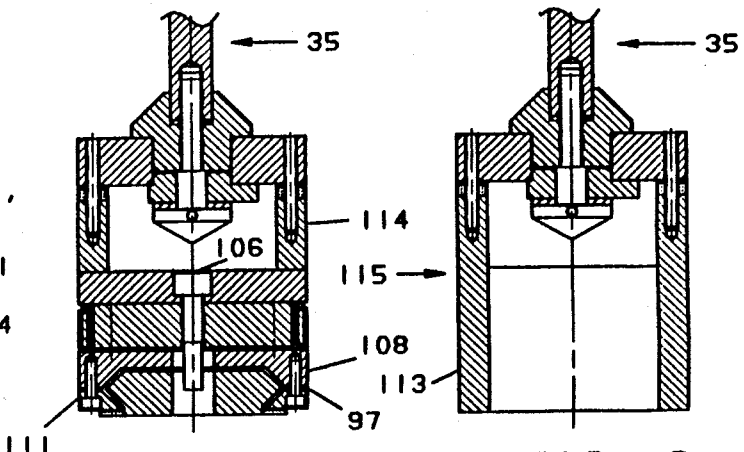
FIG. 7
FIG. 8

SUPPORTING AND FASTENING MEANS FOR MOLD BLOCKS IN A CONTINUOUS BLOCK CASTER

BACKGROUND OF THE INVENTION

In the past, many designs have addressed the problem of casting a molten metal into a moving mold, continuously, with an operable and reliable machine. Towards this end, about 20 years ago, Lauener disclosed a continuous casting machine in U.S. Pat. No. 3,570,586, which used multiple mold block assemblies to form a continuous mold cavity from which molten metal emerged as a slab casting. Because the machine uses mold blocks it is referred to as a "block caster", and because it continuously casts a slab (or "strip") it is also referred to as a "slab caster". The uphill struggle by many persons skilled in the art, to establish the Lauener machine as a viable contender against competing commercial "belt casters", has over the years, spurred much effort towards refining concepts incorporated in machines able to produce a quality slab casting, reliably and economically.

This invention is specifically directed to separate supporting and fastening means which are together referred to as "mounting means", employed for attaching a mold block to a carriage block in any continuous block caster. An internally anchored mold block, and a support pin which anchors the mold block through its "non-casting face", have been designed to minimize the effects of thermal deformations to which mold blocks are subjected in the block caster. By "non-casting face" we refer to the horizontal face of a mold block which does not contact molten metal; the horizontal face which does, is referred to as a "casting face"). The interaction of the elements of the mounting means and the internally anchored mold block is unobviously effective to cope with such effects, particularly the vertical expansion, which is minimized to such an extent that no compensation for the expansion which does occur, is necessary.

As will presently be evident, the goal of this invention is to provide a block caster able to cast a slab of uniform thickness with unstriated, substantially smoothly planar upper and lower surfaces formed between upper and lower reference planes defined by the casting faces of opposed mold blocks. To cast such a slab, the casting faces of the opposed mold blocks are to be maintained in their corresponding reference planes while they travel through the mold cavity of the block caster.

In a block caster, a pair of synchronously driven endless trains of mold block assemblies ("casting trains") travelling in paths which resemble loops, define a substantially linear horizontal mold cavity having open ends, when the opposed "casting faces" of mold blocks in the mold block assemblies come together in spaced-apart relationship, facing each other, along the linear portions of the loops. Each loop has its linear portion connected by upper and lower arcuate portions or "bends" which complete the loops, and the mold block assemblies are endlessly interconnected and oppositely disposed relative to one another in the adjacent linear portions of the loops. The mold cavity is preferably defined in conjunction with "side dams" which together confine the molten metal in the moving mold cavity.

A casting nozzle is inserted near one open end, referred to as the "molten end", to supply the mold cavity with molten metal from a tundish. The molten metal cools as it progresses with the mold block assemblies until the slab emerges from the other open end, referred to as the "solid end". The longitudinal direction in which the molten metal is cast is referred to as the "casting direction" or the x-axis. The lateral direction, orthogonal to that in which the metal is cast, is referred to as the "transverse direction" or y-axis; and the vertically spaced-apart distance of the mold block faces which define the thickness of the cast slab is said to be in the vertical direction, or z-axis.

As one might expect, to cast a slab with uniformly rectangular cross-section, it is essential that, in the mold cavity, the faces of the mold blocks defining the upper surface of the slab be in the same plane, and that the faces of those mold blocks defining the lower surface of the slab be in the same plane. When any portion of the face of a mold block is displaced from its original planar configuration, the slab cast will not have planar upper and lower surfaces. Depending upon the type of displacement, the surfaces will be arcuate, rippled or striated. When the mold blocks are not contiguous, or, if their vertical sides are not planar when they are touching, the surface of a cast slab will be striated, referred to as "ribbed"; if the edges of the blocks are thermally distorted so as to result in "bumps" (explained herebelow), the surface of a cast slab will also be striated, said to be "grooved". Whether ribbed or grooved, if present, such striations are clearly visible in the cast slab, for example as seen in the color photograph in the article titled "Small Aluminum Companies Speed Up, Spread Out" by George McManus, *Iron Age*, Feb '91.

Portions of the mold block faces are unavoidably displaced because they get heated to a high temperature when they contact molten metal at the molten end, then cool progressively as they transfer heat to the mold block as it reaches the solid end. The mold blocks are necessarily distorted due to the temperature gradients which are three-dimensionally distributed through the mold block. As the mold blocks cool and the molten metal solidifies, their original dimensions begin to be restored, returning to normal when sufficiently cooled, if the edges of blocks are undamaged.

Under actual operating conditions, the distortions of the mold blocks are such that they exert enormous pressure against contiguous mold blocks forcing the metal of the blocks out of their planar conformance in edge-abutting protuberances, referred to as "bumps". These bumps interfere with the smoothly planar definition of the surfaces of the upper and lower series of mold block faces. As a result, the upper and lower surfaces of the slab are neither planar nor smooth (that is, have poor "surface accuracy"). Such a slab is unacceptable in commerce because its surface contains cracks, or, provides locations from which cracks can propagate when the slab is rolled. A slab with poor surface accuracy is evidence of the "casting problem"—the less accurate the surface, the greater the problem.

The design and construction of a block caster derives from a fundamental decision whether to restrain the forces of distortion by equal and opposite restraints, or, to control and limit the distortions without substantially restraining them, and to cope with the controlled distortion.

We decided that the first step towards solving the well-recognized problem of poor surface accuracy was to provide a machine designed to allow the mold blocks to undergo their cyclical thermal changes without substantially restraining them, yet without interfering with the continuously planar configuration of the opposed surfaces of the mold cavity.

To this end, in our copending patent application Ser. No. 07/674,664 we provided "microslits" in the face of each mold block. We minimized the "mechanical noise", for example, the vibrations transmitted to the mold blocks during operation, by providing elastic hinges which maintained the faces of mold blocks in each carriage track, in or near the open ends of the mold cavity, in essentially contiguous relationship even in the "bends" of each continuous carriage track. By "essentially contiguous" we mean that casting faces of mold blocks are horizontally spaced apart ("gapped") less than 0.020" (inch) preferably less than 0.005"; and, vertically spaced apart ("set") less than 0.020", preferably less than 0.005", so as to form a smoothly continuous arcuate surface in the bends. The elastic hinges eliminated the mechanical excitation (familiarly referred to as "banging") caused by impact in the "bends" of a "loop", of adjacent mold blocks having radially divergent corners, and circumferentially spaced-apart faces.

Because a mold block supported from a carriage block, must be replaceable in any block caster irrespective of the details of the particular design and construction of the block caster, we have provided for replacement of a mold block, together with the support pin assemblies which support the mold block, quickly and easily. We have invented a method for substituting a 'fresh' (new or remanufactured) mold block assembly for one which requires replacement even in a block caster in which mold block assemblies are interlinked as if in a chain (hence referred to as "chain-wise linking"). Such chain-wise interlinking is unlike the linking in the '586 patent which teaches separate mold blocks connected so that removing one mold block allows the remaining mold blocks to separate from one another in the train. In chain-wise interlinking, removing a mold block to separate the ends of the chain, allows one to hold all the mold blocks supported by only the first mold block at one end of the chain. Because of the inherent difficulty of replacing a mold block in this chain-wise configuration, which is the linking in the most preferred embodiment of the invention, it is particularly surprising that a substitution may be made in a manner as effective as we have devised.

Despite the features we have disclosed for a block caster in our '664 application, which features redound to superior operation of that block caster, we found that the conventional mounting means, such as are disclosed in the aforesaid Lauener '586 patent, fail to provide a sufficiently high quality cast slab, reliably and routinely. By "sufficiently high quality" we refer to a slab which is acceptable to a customer who purchases slabs for his further use, for example, to be rolled into "can stock" for beverage cans.

Briefly, the mounting means used in the '586 patent secures a mold block to a guide member. The mounting means relies upon a bolt 15 one end of which is threadedly secured in the geometric center of a rectangular mold block 10; the other end of the bolt 15 is passed through a bore in a guide member 11 and tightened against it with a nut 16 and an interposed spring washer (cup spring) 17. Four supports (bolts) 12, two on either side of the bolt 15, are provided with spherical rounded ends which rest on backings 13 of hardened steel. The backings 13 are in the form of plane discs having a raised rim and the rounded ends of the bolts are in contact with the planar discs so that when the mold block 10 expands or contracts the bolts 12 assume a sloping position. Thus when the mold block does move laterally, it causes rotation of one spherical rounded end of each bolt 12 (in a backing 13 which is sunk in the mold block 10) and a simultaneous, corresponding rotation of the other spherical rounded end of the bolt in another backing 13 sunk in the guide member 11. This causes a displacement along the diameter of the sphere (of which the spherical rounded ends of the bolts are opposite portions), and there is no change in the distance between the mold blocks and the carriage block (or 'guide member', see col 3, lines 61–75).

In the '586 patent, Lauener expected to maintain the distance between the non-casting face of the block and the carriage block constant with the aforesaid bolts with spherical rounded ends. But these bolts are unable to accommodate anything but the smallest vertical expansion even with the assistance of the spring washer (cup spring 17). A large, if not major portion of the vertical expansion of the mold block occurs after the cast slab solidifies. Under such conditions, the casting face of the block is positioned against the solidified slab and cannot move, forcing movement of the non-casting face of the block away from the slab. This exerts great pressure on the carriage block and associated structure of the block caster, which pressure forces the casting face of a mold block in the processing zone out of the reference plane for the faces of mold blocks of each train in that zone. Such pressure also accelerates distortion of the casting face of the mold block. The bolts with spherical rounded ends and the spring washer of the '586 structure are ineffective to cope with the relatively large vertical expansion which results after solidification of the slab.

The foregoing will be better understood upon envisioning the sequence of events in the processing zone. At the start, when molten metal contacts the casting faces of specific opposed mold blocks at the mouth of the mold cavity, the thermal gradient between the casting face and non-casting face of each of those molds block is greatest. The initial expansion of each mold block due to this gradient, forces each casting face out of its reference plane for the casting face of that mold, immediately. Since the melt offers little resistance, the opposed casting faces of those mold blocks move towards each other, squeezing the cooling melt into a thinner (measured along the z-axis) slab than when the faces of the mold blocks first commenced to form the mold cavity.

As the melt cools while travelling through the mid-portion of the mold cavity, those specific mold blocks continue to expand vertically and laterally. Such vertical expansion progressively further forces the casting faces of those opposed mold blocks towards each other, and forces each casting face out of its respective reference plane, so long as the central portion of the cooling slab is relatively soft and compressible, though the slab, near its surface, is solid.

As the cooling slab continues to travel through the mold cavity, the thermal gradient between the casting and non-casting faces of those mold blocks is decreased relatively rapidly because of the typically high thermal conductivity of any metal preferred for use as a mold block. At this later stage in the travel of the slab through the mold cavity, the slab is solidified and essentially incompressible so that further vertical expansion of each of those mold blocks results in force being exerted against the carriage block assembly, thus "loading" it in proportion to the magnitude of the force exerted. It is this force exerted against the solidified slab which causes displacement of the backings 13 and rotation of the spherical rounded ends of the bolts 12 in the block caster of the '586 patent. Near the far end of the mold cavity where the slab is solidified, the displacement of opposed casting faces towards each other is essentially zero because the slab is incompressible, and, the displacement away from each other is relatively small compared to the displacement of those casting faces in their travel through the initial and mid-portions of the mold cavity, because of the limitations imposed by the bolts 12 in their backing plates.

The mold block 10 in the '586 patent is maintained in the central position relative to the guide member 11 by means of three guide pieces 21, 22 and 23 screwed on to the guide member and slide in grooves 18, 19 and 20. The guide piece 23 prevents lateral displacement (along the y-axis), and guide pieces 21 and 22 prevent displacement in the casting direction (x-axis).

As will be evident from the placement of the bolts 15 which externally anchor the surface of the mold block 10 to the guide member 11, during operation of the block caster described in the '586 patent, the displacements due to the vertical expansions referred to hereinabove will correspond to the vertical expansion of the entire block. In contrast, in the detailed description of a preferred embodiment of an internally anchored mold block herebelow, the displacement due to such vertical expansion is limited to the thickness of only that portion of the mold block near its face, which portion is defined by the distance (referred to as the "heat-sensitive distance") between the casting face and the lateral centerline of an anchor for a support pin of a support pin assembly. When this heat-sensitive distance is less than one-half the height or thickness (measured along the z-axis) of the mold block, preferably one-third, the vertical expansion attributable to such distance is less than one-half that attributable to the entire thickness of the mold block.

It will now be evident that Lauener (in '586) failed to accommodate the vertical expansion of the mold block and its supporting means by the spring washer (cup spring 17). The spring washer and spherical rounded ends of the bolts 15 could only accommodate a portion of the lateral expansion of the block by angulation of the bolts 15. As did others in the prior art, Lauener failed to make provision to cope with relatively large changes in positions of the casting faces of opposed mold blocks as they are forced towards each other while the slab is compressible, or as they are forced away from each other after the slab is solidified.

The positions of the casting faces are not fixed prior to solidification of the slab, but "float" up and down due to thermal changes. For casting aluminum, this vertical expansion (in the direction of the z-axis) is about 0.32 mm for a mold block of practical thickness (say 10 cm, measured along the z-axis), and is too great to be accommodated by any prior art vertical compensating means.

We have found that it is most desirable to maintain the relative positions of opposed casting faces of mold blocks substantially coplanar in their respective reference planes throughout the casting zone, and to do so, the vertical displacement of these faces relative to each other must be minimized. We have been able to do this by supporting each mold block with an insulated support pin anchored within the mold block, relatively close to the casting face of the mold block, so that such vertical distortion as is transmitted to the support pin is too little to cause undesirable striations in the surface of the cast slab. Thus the casting faces of contiguous mold blocks of each loop, maintain a substantially coplanar configuration in the casting zone, which coplanar configuration in turn, results in substantially smoothly planar upper and lower surfaces of a cast slab which is commercially highly desirable for further processing.

SUMMARY OF THE INVENTION

It has been discovered that a mold block assembly supported by one end ("proximal end") of a support pin in a support pin assembly, the other end ("distal end") of which pin is secured in a slide means ("slide member") so that the distal end may be displaced in a plane generally parallel to the casting face of the mold block, provides effective compensation for variable planar displacements along the mold block. The slide member, which includes a planarly displaceable member, is mounted on a carriage block of the block caster. Several slide members are each located at each of plural locations along the mold block.

It is therefore a general object of this invention to provide a mold block assembly demountably secured to a carriage block assembly in a block caster, by mounting means in which the supporting means comprises (i) a central support pin assembly including a support pin, one end of which is fixedly secured along the central x-axis of the mold block, to anchor the middle of the block against relative side-to-side displacement along the y-axis; and, the other end of which pin is non-displaceably secured relative to a fastening member of a mounting block mounted on a carriage block; and, (ii) plural, flanking support pin assemblies on either side of the central, each having a support pin, one end of which is fixedly anchored within a mold block, and the other end of which pin is movably secured in a planarly displaceable fastening member of a slide member mounted on a carriage block.

It has also been discovered that it is not necessary to compensate for vertical expansion of a mold block in a block caster. Excellent surface planarity of a cast slab may be obtained by minimizing the effects of thermal deformation of a mold block. With minimal transmitted vertical growth due to thermal deformation, the casting faces of mold blocks in the upper and lower casting trains of a block caster are maintained in defined upper and lower essentially fixed reference planes. The positions of the reference planes remain essentially fixed by providing thermal insulation means for each end of each support pin which is securely insulatedly anchored within a mold block, preferably near the casting face of the mold block.

It is therefore a general object of this invention to provide a combined mold block and support pin assembly which transmits minimal thermal expansion thereof in the vertical direction. Preferably the transmitted thermal expansion (in the vertical direction, z-axis) is so small that no means to compensate for such expansion is required to produce a slab with excellent surface planarity.

It is a specific object of this invention to provide supporting means for a mold block assembly, the supporting means including (i) a central support pin secured along the central axis (in the direction of the x-axis) of the mold block to provide a vertical support which does not permit relative movement between the carriage block, the central support pin assembly, and the mold block, and (ii) plural support pins arranged in fore (or "front") and aft (or "rear") rows, the support pins together supporting each mold block near the edges of its non-casting face, and at least the support pins in one row near an edge (either a "leading edge" or a "trailing edge") are displaceable in any direction in one plane (referred to as being "planarly omnidirectional").

It is another specific object of this invention to provide a support pin assembly including an elongate support pin, a centering stop, a lock-down plate, a camming means, preferably in the form of a stepped lock-down key, and a pilot.

It is another general object of this invention to demountably secure a mold block assembly to the carriage block with multiple support pins one end of each of which is secured within each mold block with an anchor pin sheathed in an insulating sheath, and the central transverse axis of the anchor pin (in the direction of the y-axis) is nearer to the casting face of the mold block than to its center line; and, the other end of each of which support pins is demountably locked to a locking plate secured to fastening means carried by the carriage block.

It is another specific object of this invention to provide fastening means comprising a slide member having a "y-slide" (so termed because a support pin held therein may move to-and-fro along the y-axis), including a slide base with a central recess, a slide "way", a slide which is displaceable back and forth between the slide base and the slide way, preferably with interposed upper and roller bearing means, the slide having a slide channel secured thereto with a stop screw which is displaceable within the confines of the central recess in the slide base.

It is another specific object of this invention to provide a slide member comprising an x-y slide, including stacked y-slides, more specifically an upper y-slide mounted on a lower y-slide, provided the to-and-fro direction in which one y-slide is displaceable is orthogonal (at right angles) to that in which the other is displaceable.

It is still another specific object of this invention to provide a mold block assembly including a rectangular parallelpiped mold block of heat conductive metal, preferably copper, the fore and aft faces of which mold block are provided with opposed lateral bores in which anchor pins, snugly fitted in heat insulating sheaths, are inserted; and the non-casting faces of the mold block are provided with vertical bores each of which communicates with a lateral bore, the vertical bores being provided with sleeves of thermal insulation snugly fitted therein.

It is yet another specific object of this invention to provide a rigid planar heat shield mounted in vertically spaced apart relationship with the non-casting face of the mold block, the heat shield having passages therein, through which support pins are inserted.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations like reference numerals refer to like elements, and in which:

FIG. 5 is a cross-sectional view along the plane 5—5 in FIG. 2, showing details of the mold block and the interior thereof, the support rods, a stepped lock-down key which locks a support pin in place, the y-slides and the x-y slides.

FIG. 6 is a cross-sectional side view of a y-slide shown in FIG. 5, and the stepped lock-down key which locks and unlocks the support pin to a slide channel of the y-slide.

FIG. 7 is a cross-sectional side view of an x-y slide, and the stepped lock-down key which locks and unlocks the support pin to the slide channel of the x-y slide.

FIG. 8 is a cross-sectional view along line 8—8 in FIG. 2, of the center anchor.

DETAILED DESCRIPTION OF PREFERRED EMBODIMENTS

It is essential, for optimum operation of a block caster, that the casting faces of adjacent blocks be maintained in essentially contiguous, substantially smoothly planar (in the mold cavity), or smoothly arcuate (in the bends) relationship with each other. During operation, thermal loads cause separation of mold blocks in the casting direction. In addition, thermal loads cause distortion of the casting faces of the mold blocks. The amount of distortion varies from block to block ("interblock distortion") depending upon the position of the block in relation to the casting, and from one position to another within each block ("intrablock distortion") again depending upon the position of the block in relation to the casting.

To maintain the smoothly planar configuration of the casting faces in the casting zone, both in the casting direction and one transverse thereto, it is preferred that distal ends of the support pins in the rear row, near the aft edge be secured in planarly unidirectional slides ("y-slides"). The aft edge is also referred to as the "trailing edge", this being the edge of the mold block last to contact molten metal being introduced into the mold cavity. Unidirectional slides are referred to as "y-slides" because the ends of rods secured in y-slides can be displaced back and forth along the y-axis only, within a range from about 1 mm to about 13 mm, chosen to cope with elongation of the mold block. Most preferably the distal ends of the support rods are secured in "y-slides" mounted on a carriage block which, in turn, is secured to hinge blocks.

In a preferred embodiment, the distal ends of all support pins except the center pin, in each rear row are locked in a lock-down plate of a y-slide, and the distal end of each support pin in the front row, near the fore edge of each mold block is secured to a lock-down plate in a planarly omnidirectional slide member ("x-y slide"). If desired, the relative fore and aft positioning of the rows ma be interchanged. The fore edge is also referred to as the "leading edge", this being the edge of the mold block first to contact molten metal being introduced into the mold cavity.

Omnidirectional slides are referred to as "x-y slides" because the distal ends of support pins secured in x-y slides may be displaced in any direction in the x-y plane within a predetermined zone. Though, in the casting of aluminum, the maximum lateral terminal displacement of a pin is within a zone having a diameter in the range from about 0 to 1 cm, an x-y slide provides a displacement zone having a diameter of 2.6 cm. Though each mold block assembly may carry y-slides in either the front or the rear rows, and the x-y slides in the other row, the center support pin in the row of y-slides is non-displaceable relative to a center mounting block to which the center support pin is fastened.

Figure 1:
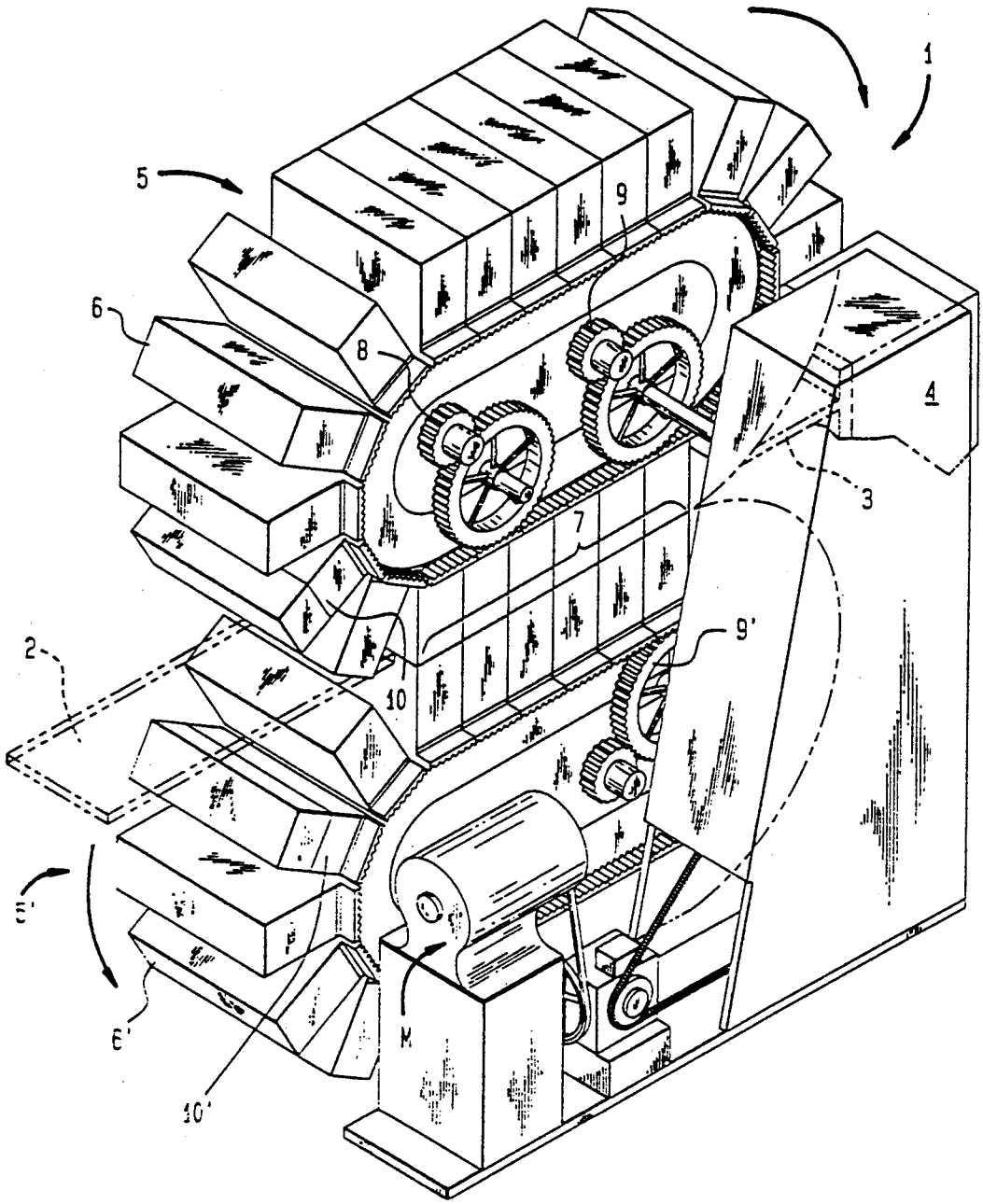
FIG. 1 is a perspective view schematically illustrating a continuous casting machine referred to as a block caster.

Schematically illustrated in FIG. 1 is the block caster, referred to generally by reference numeral 1, which has the general appearance of a prior art machine. The arrows indicate the direction in which each casting train is driven. In operation, the machine continuously casts a slab 2 of metal formed from molten metal flowing from the nozzle 3 of a tundish 4 (shown in phantom outline). Any molten metal which is castable may be cast in a block caster, but in the preferred embodiment the metal cast is a non-ferrous metal, specifically aluminum.

The block caster 1 comprises a pair of upper and lower casting trains, referred to generally by reference numerals 5 and 5', configured as twin loops which define the path of each train. Each casting train 5 and 5' comprises a multiplicity of endlessly connected mold block assemblies 6 and 6' respectively, which are essentially identical to each other with respect to their structural components. The mold block assemblies 6 and 6' come together facing each other, preferably between side dams (not shown), and move synchronously over the length of one side of the loops, to define a mold cavity 7.

The upper casting train 5 is driven by a pair of drive gear assemblies 8 and 9, and the lower casting train 5' is driven by a pair of drive gear assemblies 8' (not shown) and 9'. In operation, the drive gear assemblies provide opposed torques to control the movement of the mold block assemblies through the mold cavity. Molten metal enters the mold cavity at the upstream end and emerges as a cast slab 2 at the downstream end, thus establishing the casting direction. Each drive gear assembly is driven by an electric motor M, only one of which is shown. The desired speeds at which the casting units are synchronously driven are maintained by computer control according to the demands of the various process parameters.

The mold block assemblies in each loop are necessarily subjected to a thermal cycle in which they (a) are heated rapidly when they come in contact with the molten metal at the molten end of the mold cavity, (b) continue to be heated as they travel through the casting zone, in the casting direction (shown by the arrows), as molten metal solidifies into the slab in the mold cavity, (c) begin to cool after they leave the solid end and enter a bend before a cooling zone, and (d) are further cooled in the cooling zone before they traverse another bend and re-enter the casting zone at the molten end.

The temperature of molten aluminum being cast is about 1300° F. (704° C.), and the slab cools to about 900° F. (482° C.) as it emerges from the casting zone, so that those portions of the mold block assemblies in contact with the molten metal are heated to near 800° F. (427° C.) while the rest of the mold block is at about 400° F. (204° C.). The entire mold block gradually then heats up to an average temperature of about 500° F. as it leaves the mold cavity. The mold block assemblies then go around the bends in each loop at one end of the block caster, and enter the cooling zone where they are cooled, typically with a water spray, to about 204° C. at which temperature they enter the bend at the other end, prior to re-entering the casting zone.

The mold blocks may be provided with casting faces which are flat (as shown), or if desired, with generally U-shaped faces having projecting end surfaces, or an L-shaped face having a single projecting end surface. When U-shaped, the corresponding projections of opposed blocks of the upper and lower casting trains define a channel portion of the mold cavity 7 when the projections come together. When L-shaped, the projections of mold blocks in the upper casting train 5 come into contact with a mold block of the lower casting train, which mold block has no projection, and thus together define the mold cavity 7. Irrespective of which specific type of mold block is used, it may be used with side dams (not shown), one on each side of each casting train. The side dams travel synchronously with the casting trains with the inner face of the side dams in contact with the ends of the mold blocks so as to confine the metal. Such side dams are essential with the mold blocks having planar faces (shown in FIG. 2) which are preferred.

The mold blocks are supported by mounting means 10 which include (i) supporting means comprising support pin assembly 35 and (ii) fastening means 45, comprising plural slide members, details of each of which are more clearly shown in FIGS. 5-9.

A support pin assembly and its associated fastening means together form a mounting unit. Plural mounting units are linearly spaced apart, about equidistantly, along the length of the non-casting face of a mold block assembly. Typically the mounting units ar spaced about 1 ft (30.5 cm) apart.

Figure 2:
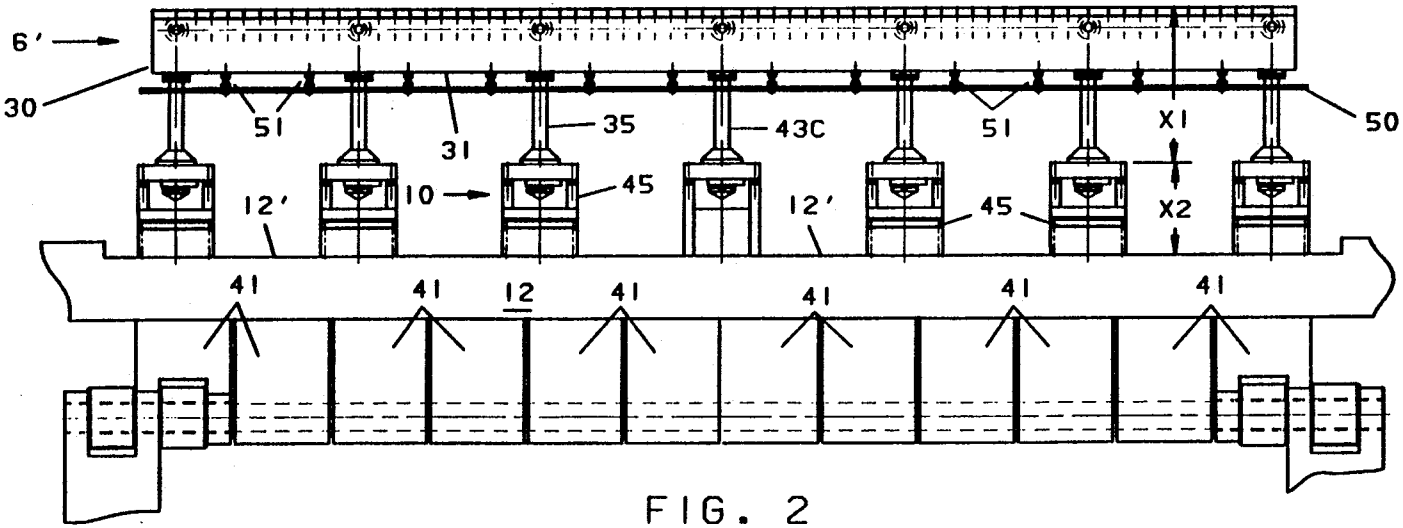
FIG. 2 is an elevational view schematically illustrating a portion of a casting train having a mold block assembly carrying a heat shield, a carriage block assembly including hinge blocks, and mounting means to lock and unlock the distal ends of support pins which are fastened with quick-locking and unlocking means to a lock-down member in fastening means mounted on the carriage block.

The configuration of a unit of a casting train, which unit comprises plural support pin assemblies connecting a mold block assembly to a carriage block assembly, but without showing details of hinge blocks carried by the carriage block, is shown in FIG. 2.

As will be explained hereafter, a unique quick-locking and unlocking mechanism facilitates the change of a complete mold block assembly with associated support pin assemblies, within a very short time. This is accomplished by unlocking the distal ends of support pins in the lock-down plate of a fastening member which fastens the pins to the slide members, which are in turn, fastened to the carriage block. This feature in the block caster makes it practical to change a mold block assembly with a minimum of effort and down time.

Figure 3:
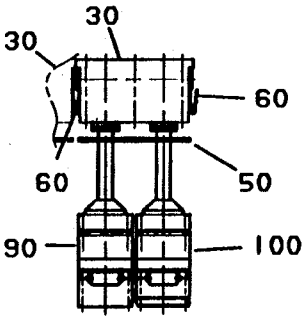
FIG. 3 is a partial end view of the mold assembly portion of shown in FIG. 2, showing the mold block supported by fore and aft rows of support pin assemblies carried by a y-slide adjacent an x-y slide; flexible laminar heat shields carried along the transverse sides of the mold block, showing a heat shield on one side connected to another mold block; and, a heat shield disposed intermediate the non-casting face of the mold block and the fastening means.
Figure 4:
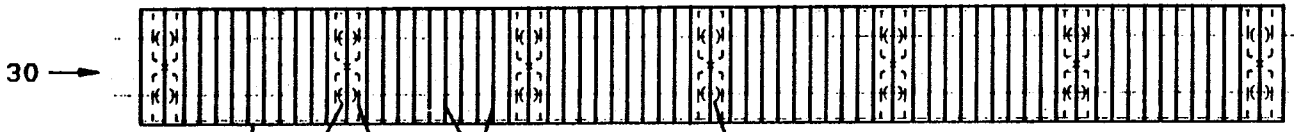
FIG. 4 is a top plan view of the a mold block assembly in the lower casting train, (i) illustrating microslits in the casting face of the mold block, (ii) indicating the positions of multiple (fourteen) supporting and fastening means on a preferred mold block assembly, and (iii) showing in dashed outline, 14 laterally disposed internal anchor pins with insulating sheaths within a mold block, in which anchors are anchored support pins.

Details of a mold block assembly not visible in FIG. 1 are shown in FIGS. 2–4, in which a mold block assembly 6' comprises a mold block 30 of rectangular cross-section, supported by mounting means 10 from a carriage block 12 which is provided with a machined planar surface 12'.

In the best mode shown in FIG. 2, the supporting means comprises plural support pin assemblies 35; the fastening means comprises a central fixed member and plural y-slide members disposed on either side of the fixed member, and, a row of plural x-y slide members oppositely disposed relative to the y-slide members on a non-casting face 31 of mold block 30, all of which fastening means 45, in turn, are secured to the carriage block 12 carried by hinge blocks 41.

Each mold block 30 has mounted on the non-casting face 31 thereof, a heat shield 50 maintained in spaced apart relationship with the mold block 30 by spacers (or set-off pins) 51. Two rows of mounting units are provided, those in one (fore) row being oppositely disposed relative to those in the other (aft) row, and at least three mounting units are used in each row, the number and spacing therebetween depending upon the width (measured along the y-axis) of the slab being cast. For a slab 2 meters wide, seven mounting units are used (as shown) in each row.

As shown in FIG. 2, plural support pin assemblies 35 and slide members 45 together serve as plural mold block mounting means 10 which are transversely disposed (along the y-axis), so all the mold blocks 30 of a casting train travel in the casting direction oriented at right angles to the direction of casting. The blocks are biased, one against the other through the casting zone to form a seamless mold cavity with planar upper and lower walls, with the aid of opposed torques generated by the drive gear assemblies of each train.

In FIG. 3, which is an end view of a portion of the carriage assembly shown in FIG. 2, the relative positions of mounting means in each row is shown. Also shown is a portion of a contiguous second mold block 30, connected by a flexible and expansible heat shield 60 of ceramic cloth, another such flexible heat shield 60 being used to connect a third contiguous mold block (not shown).

Referring now to FIG. 4, there is shown a top plan view of a mold block 30 of the lower casting train 5', particularly the mold block's casting face 36 which is provided with microslits 37. Also provided are internal longitudinal bores 38, and communicating therewith, vertical bores 39 (shown in dotted outline). The bores 38 and 39 are for anchor pins 42 and support pins 43 respectively (see FIG. 5). As illustrated, the mold block is about 2 meters long and the bores 39 for a pair of displaceable support pins 43, are located near each transverse edge of the mold block 30, closely spaced apart along the x-axis. The bores near the ends of the mold block are referred to as "end bores". The remaining bores for pairs of closely spaced, oppositely disposed support pins are spaced equidistantly between the end bores, along near the fore and aft edges of the mold block, and are referred to as "intermediate bores". The intermediate and end bores are symmetrically disposed in mirror-image relationship relative to a pair of "central bores" along the longitudinal x-axis of the mold block, and preferably only one support pin in a central bore anchors a support pin non-displaceably in the x-y plane.

The number of bores used will depend upon the length of the mold block, the shorter the mold block the fewer the support pins and bores required. Even for a long block 2 meters long, the number of support pins used is not narrowly critical, but it is preferred to have at least one pair of intermediate bores and one pair of end bores on either side of a pair of central bores even for a relatively short mold block 1 meter long.

In a less preferred embodiment even for use with a relatively short mold block, bores may be provided for single support pins which may be used along the transverse length of a mold block, instead of pairs of support pins. The bores for single support pins may be spaced along the central lateral axis (the y-axis) of the mold block, or staggered on either side of the y-axis, each bore being located alternately near the fore edge, then the aft edge of the mold block. In such an embodiment it is still preferred to support the mold block from both y- and x-y slides disposed on either side of a centrally anchored support pin.

Referring to FIG. 5 there is shown in greater detail, a portion of the mold block 30 having a longitudinal insulating cylindrical sheath 52 snugly fitted in longitudinal bore 38 (FIG. 4). The sheath 52 is provided with a vertical through-bore 54 through which the proximal threaded end 55 of support pin 43 is slidably inserted. An insulating disc 53 is pressed against the end of the bore 38 and an anchor pin 42 having one vertical threaded bore 44 and one longitudinal threaded bore 46 is snugly fitted in cylindrical sheath 52.

A vertical cylindrical insulating sheath 56 is snugly fitted in vertical bore 3 (FIG. 4) and the bore of the vertical sheath 56 is in open communication with bore 54 in longitudinal sheath 52 so that the upper portion 66 of the support pin 43 within the mold block is thermally insulated from the mold block. The threaded proximal end 55 of the pin is threadedly secured in the vertical threaded bore 44 of the anchor pin. To ensure that the support pin will remain secured in the anchor pin, a set screw 57 is threaded into longitudinal bore 46 and tightened against the threaded proximal end 55 of the support pin 43. A flat-head screw (not shown) secures a side heat shield 60 which interconnects adjacent mold blocks, and a retainer 61 of ceramic fabric which insulates the end of the anchor pin 42.

The upper portion 66 of the support pin 43 is stepped down in diameter at shoulder 62 outside the mold block and is provided with an insulating washer 63 which snugly fits around the vertical sheath 5 and insulates both the support pin 43 as well as an anchor shim pack 64 and an anchor Belleville washer 65 which together help set the casting face 36 in the desired reference plane. The fastening means 45 are preferably insulated from the mold block 30 by a laminated heat shield 50. The upper surface of the heat shield nearer to the mold is preferably a ceramic strip 58 backed by a strip of polished stainless steel.

From the foregoing description it will now be evident that the function of the insulation around the anchor pins and the proximal end of the support pin is to minimize the rise in their temperature during the time the casting face of the mold block is in contact with the hot aluminum. In addition, the placement of the anchor pins near the casting surface of the mold block results in the transmission of vertical thermal expansion of only a partial thickness of the mold block, namely, that portion of the mold block between the center line of the anchor pin and the casting face of the mold block. The distance (partial thickness of the block) from the casting face of the block to the nearest edge of the insulating sheath is typically less than one-third the height of a mold block. Hence the vertical thermal expansion attributable to this partial thickness is only one-fifth to one-third that which would be experienced if the support pin was anchored on the non-casting surface of the mold block. The placement of the proximal end of a support pin within the block instead on the non-casting surface, avoids having to compensate for the entire vertical expansion and contraction of the mold block.

By "the entire vertical expansion" we refer to the thermal expansion, in a direction at right angles to the face of the slab, attributable to the entire thickness of the mold block. For example, when a typical copper mold block is 10 cm (4 in) thick (z-axis), 19 cm (7.5") wide (x-axis) and 2 meters (6.5 ft) long (y-axis), the vertical expansion ($\delta z$) of the entire block (coefficient of expansion $\alpha=9\times10^{-6}$) when it is heated from a base temperature of 400° F. (204° C.) until it reaches a mean temperature of 750° F. (399° C.), is about 0.0126 inch (12.6 mils=320 microns), and this expansion cannot be accommodated by the cup spring 17 of the Lauener '586 patent. When the center line of the insulating anchor sheath is 3 cm (1.2") from the casting surface, and the mean temperature of that 3 cm thickness is 750° F. (359° C.), the vertical expansion due to its rise in temperature of 350° F. (177° C.) is 0.096 mm (0.003"=3 mils). Such distortion, up to about 5 mils, of the plurality of the cast surface of a slab does not adversely or noticeably affect its quality.

Figure 9:
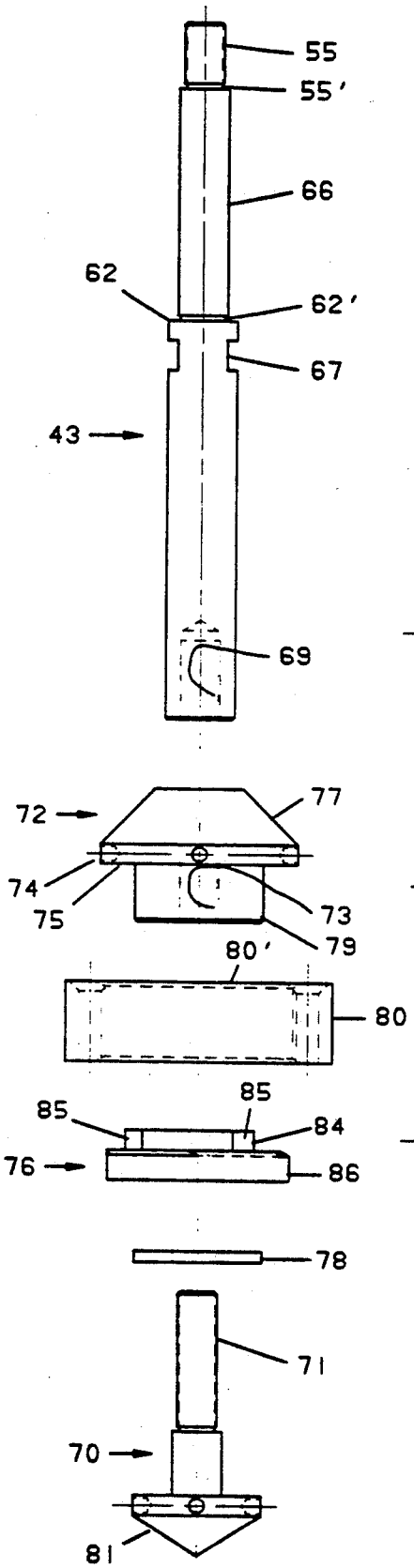
FIG. 9 is a side-elevational exploded view of a support pin assembly.

Referring now to FIG. 9 which illustrates each of the structural elements of a support pin assembly, it is seen that the support pin 43 is provided with parallel grooves 67 and 67' to provide purchase with an open end wrench, the grooves being just below shoulder 62. The wrench is used to tighten the support pin in the threaded bore 44 of the anchor pin. A relief 62' is cut into the upper portion 66 adjacent the shoulder 62 to avoid machining a right angle at the step. For the same reason, a relief 55' is provided at the end of the threaded proximal end 55 of the pin.

The distal end 68 of the support pin is provided with a longitudinal axial threaded bore 69 into which the threaded end 71 of a pilot 70 is secured. The pilot 70 is inserted through the central bore 73 of centering stop 72, a stepped lock-down key 76 and a Belleville washer 78. The centering stop 72 has a shoulder 74 having a lower surface 75 which is in a plane normal to the central axis of the internal bore 73. The shoulder 74 separates an upper frustoconical portion 77 from a cylindrical base 79 the outside diameter of which is such that it is snugly insertable within a triangular central passage 82 in a lock-down plate 80.

When the support pin assembly is assembled and locked onto the lock-down plate 80 by turning the stepped lock-down key 76, as shown in FIG. 5 and as will be described in greater detail herebelow, the vertical distance between the casting face of the mold block and the lateral axis of the carriage block is fixed.

Since the casting face 36 of each mold block 30 in the lower casting train 5' is to lie in a predetermined lower reference plane, it will now be evident that the overall vertical dimension ($x_1+x_2$) from the casting face 36 to the surface 12' of the carriage block 12 (see FIG. 2) must be narrowly controlled. To provide such control, the dimension $x_1$ for each mold block and support pin assembly, and the dimension $x_2$ for each slide member and associated fastening means, must therefore be narrowly controlled.

In the mold block and support pin assembly, note that when the support pin 43 is tightened into the anchor pin 42 and the pilot 70 is tightened into the threaded bore 69 of the pin 43, the distance between the casting face 36 and the lower surface 75 of the shoulder 74 of the centering stop, is adjusted with anchor shim pack 64 to be a predetermined distance $x_1$ (see FIG. 2).

The distance between the upper surface 80' of the lock-down plate 80 and the upper surface 12' of the carriage block 12 is also adjusted with shim pack 97 (FIG. 6) to be a predetermined distance $x_2$. When assembled $x_1+x_2=x_3$ within narrowly defined tolerance, typically less than 0.005", where $x_3$ is the critical overall vertical dimension to maintain the casting face 36 in its predetermined reference plane. The distances $x_1$ and $x_2$ are maintained with appropriate jigs.

To minimize thermal expansion of the support pin 43 it is preferably made from a low-coefficient material, for example Invar alloy, and the length of the pin is kept small, typically in the range from 5 cm (2") to 30 cm (1 ft).

Figure 10:
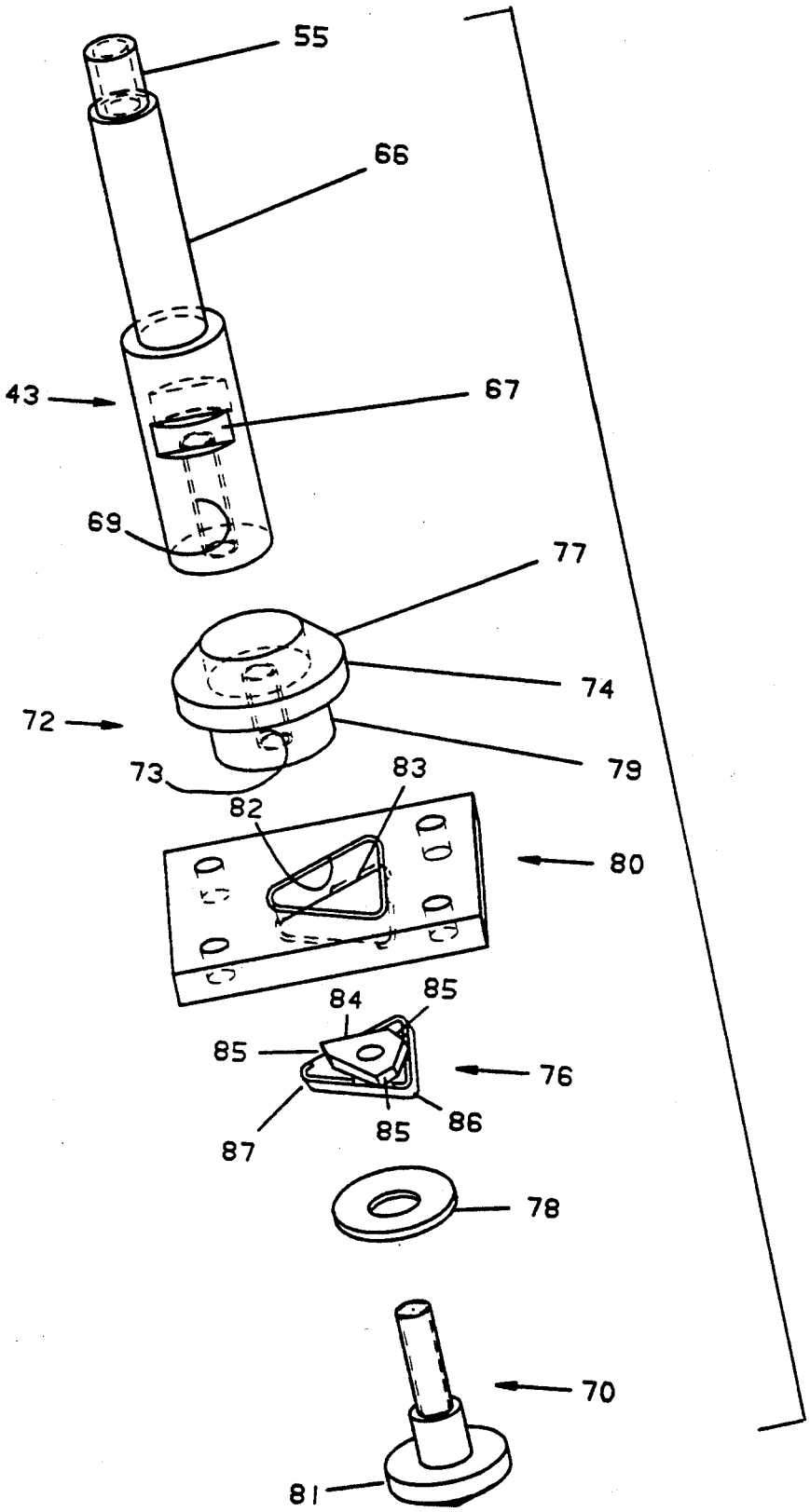
FIG. 10 is a perspective exploded view of a support pin assembly.

The camming function of the stepped lock-down key 76 is more easily visualized in the exploded perspective view of the support pin assembly illustrated in FIG. 10.

Figure 11:
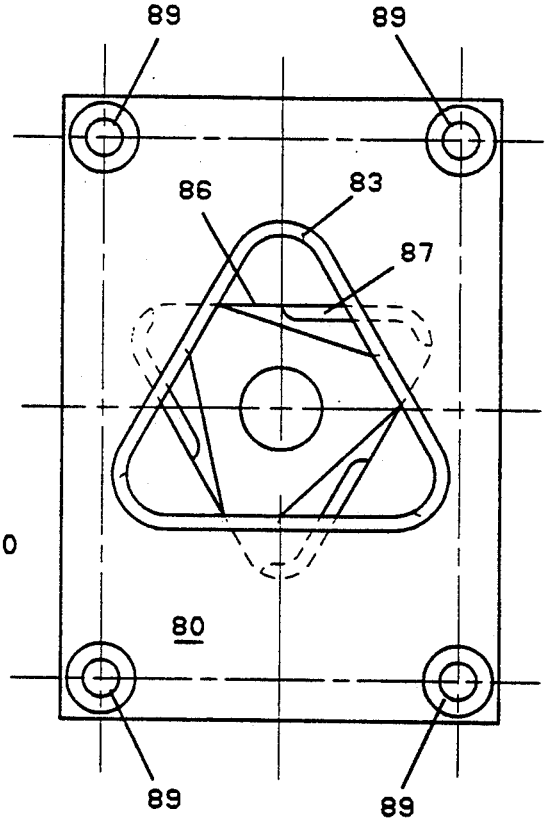
FIG. 11 is a plan view of a lock-down plate in which the stepped lock-down key has been locked in position.

Referring now to FIGS. 9, 10 and 11, it is seen that the lock-down plate 80 in plan view is a rectangular plate provided with a triangular central passage 82 with sides of equal length, through which passage the head 81 of the pilot 70 can be slidably inserted. The periphery of the passage 82 is provided with a chamfer 83 on the upper surface of the plate 80, which chamfer extends continuously along the periphery. On the lower surface of plate 80 the passage 82 is provided with separate chamfered portions 83 near each corner of the triangle.

The stepped lock-down key 76 has an upper triangular portion 84 in which the corners of the triangle are cut off to provide flats 85; and, a lower triangular portion 86 which is chamfered near the corners to provide lands 87 which may be rotated into contact with the chamfered portions 83 of the lower surface of the plate 80. The lock-down key 76 is inserted through the passage 82 and rotated against the spring-exerted pressure of the Bellevile washer 78, until the flats 85 are biased against the sides of the triangular passage 82. This locks the support pin assembly to the lock-down plate 80.

The lock-down plate 80 is fastened with bolts (not shown), through bolt holes 89, the upper peripheries of which are chamfered, to a slide channel 91 on each slide member 45 which may be a y-slide or an x-y slide, indicated generally by reference numerals 90 and 100 respectively, shown in FIG. 5. The slide channel 91 is essentially the same in each case, and is fastened to the slide 92 with a stop screw 93. The end of the stop screw 93 protrudes through the bottom of the slide 92, into a central recess 94 of slide base 95. The diameter of the recess is large enough to permit sufficient to-and-fro movement of the stop screw as may be required due to thermal expansion and contraction of the mold block at the location where the support pin is anchored to the mold block. Typically the movement is less than 0.5 cm, the precise amount depending upon the metal being cast, the location of the support pin in the mold block, and the processing conditions for casting the slab.

The slide 92 is reciprocably contained in the slide base 95 by a slide way 96 which is bolted to the slide base with an interposed slide shim pack 97 and associated insulating spacer 97'. Preferably the slide has opposed V-shaped sides 98 and 98' and a V-shaped race of roller bearings 99 is interposed between each V-shaped end of the slide and the inner surfaces of the slide way and slide base which together are matingly fitted to the interposed bearings 99 and sides 98 and 98' of the slide. The slide base 95 is fastened with fastener means, typically Allen screws to a hinge block 41 (not shown) which in turn is carried by a carriage block.

FIG. 6 illustrates an end view of the y-slide 90 showing that the lock-down plate 80 is secured to the slide channel 91 with recessed Allen screws 101, the location of the upper surface 80' being determined by an interposed slide shim pack 97 and insulating spacer 97'. The upper surface of the slide way 96 is provided with a slide seal 102 and the ends of the y-slide are provided with a slide end seal 103 held in place by an end seal retainer 104. A passage 105 is provided in the slide base 95 to communicate with the central recess 94 to allow lubricant to be injected into the slide base.

As seen in FIG. 6, the stepped lock-down key 76 is shown in its locked position, having been turned by a triangular wrench (not shown) which is inserted in the open end of the slide channel 91 and fitted around the lower stepped portion 86 of the stepped lock-down key 76.

Referring now to the x-y slide 100 in FIG. 5 it is seen that the upper portion is a y-slide substantially similar to the y-slide 90 except for the stop screw 106 which protrudes through the slide base 108 and into a second y-slide reciprocably mounted for reciprocation in an axis at right angles (hence called a "y-slide") to the axis of reciprocation of the first y-slide.

Referring to FIG. 7 it is seen that the construction of the x-slide (beneath the y-slide to which the x-slide is fastened) comprises a slide base 108 having a central through-passage 109 through which the end of the stop screw 106 protrudes into slide 110. The slide 110 is matingly contained by slide way 111 which is fastened with an interposed shim pack 97 to the slide base 108. As before each y-slide and x-slide are provided with a slide seal 102, a slide end seal 103 and an end seal retainer 104 (visible for the y-slide but not visible for the x-slide). The slide 110 is fastened to a hinge block 41 with Allen screws (not shown) which in turn is carried by the carriage block. As before the movement of the stop screw 106 due to thermal deformation of the mold block is less than 0.5 cm in any direction in the x-y plane, the precise amount depending upon the metal being cast, the location of the support pin in the mold block, and the processing conditions for casting the slab.

It will now be evident that the y-slides accommodate to-and-fro movement in the y-axis, and the x-slides accommodate to-and-fro movement in the x-axis, so that when they are combined, the x-y slide accommodates to-and-fro movement in any direction in the x-y plane within a radius of about 0.25 cm.

In a typical operation for casting a slab of aluminum, the casting faces of mold blocks which first contact the molten aluminum are quickly heated as explained above, to a temperature near that of the molten aluminum, the leading edges of the blocks being heated before the trailing edges. The thermal expansion sensed by the center of the block, in the x-y plane, is minimum at the center of the block, and increases progressively towards the ends of the mold block.

Therefore the support pin **43*c* in the center anchor 42*c*, alone is denied movement in any direction in the x-y plane and is essentially non-displaceable during operation. By "essentially non-displaceable" we refer to the support pin 43*c* having no measurable side-to-side movement in the x-y plane, and so little vertical movement due to thermal expansion that it does not adversely affect the quality of the surface of the cast slab. The support pin 43*c* is located in the central x-axis of the mold block, though in the best mode illustrated herein, preferably not in the geometrical center of the block 30**. The mold block is deliberately anchored in such a manner that the casting surface of the mold block immediately adjacent the central anchor pin, remains a reference point in the desired reference plane sought to be maintained during operation.

Referring now to FIG. 8 there is shown a support pin assembly 35 and a mounting block means 115 for the central anchor pin **42*c* which is non-displaceably restrained relative to the mounting block 115. The mounting block 115 is a U-shaped block with a base 113 and upstanding sides which define a fixed channel 114 analogous to the slide channel 91 of a slide member. The base 113 is provided with through-bores through which Allen screws are inserted to secure the base to the hinge block 41, as before. In a manner analogous to that in which other support pins 43 are locked and unlocked in position, the central support pin 43*c* is locked in a lock-down plate 80 which in turn is fastened to the upstanding sides of the fixed channel 114**.

When a mold block assembly must be replaced for any reason, for example, if the microslits 37 in the casting face are filled with debris such as oxide particles (the surface tension of molten metal is too high to allow melt to enter the microslits which are too narrow), the block caster is stopped so as to position the casting face (of the mold block to be replaced) in the vertical plane. The mold block is then supported in a supporting (first) cradle.

The refractory ceramic cloth heat shield 60 is removed allowing access between adjacent mold blocks 30 with a triangular wrench which fits around the lower triangular portion 86 of the stepped lock-down key 76. The lock-down key is turned 60° to unlock and loosen the support pin assembly. This procedure is repeated for each support pin in each of the assemblies until the mold block is fully disconnected and rests in the first cradle. The first cradle is moved away, and another (second) cradle in which the replacement mold block is cradled, is moved into the position of the first cradle. The replacement mold block assembly is substituted for the removed mold block by an analogous procedure, reversing the order of the steps for removal of the mold block.

From the foregoing detailed description it will now be evident that attempts in prior art block casters, like the one described in the '586 patent, to compensate for, or minimize the vertical expansion of the mold block, were unsuccessful. We have not tried to compensate for vertical expansion. We have minimized the vertical expansion so that we can deal with it.

An analysis of the structure of a support pin assembly we have used, shows that each support pin remains in the vertical position at all times and there is no provision for compensating for vertical expansion. Since each support pin is unable to assume an inclined position, it is unable to compensate for even a small vertical expansion. The function of the Belleville washer 78 is solely to prevent the support pin assembly from loosening under operating conditions. The function of the Bellevile washer 65 is solely to bias the anchor shim pack 64 and the anchor insulating washer 63 against the non-casting face 31 of the mold block. Such vertical expansion of the mold block as does occur, can only be transmitted through the support pin 43. Since the support pin is seated in the centering stop 72 which in turn rests upon the lock-down plate 80, the expansion generates a force against the lock-down plate which is non-displaceably mounted relative to the carriage block 12. In our apparatus, we have minimized this force.

In the specific instance where molten aluminum is cast into a slab in the range from about 1 cm (0.5") to 5 cm (2") thick, between copper mold blocks about 10.16 cm (4") thick 19.05 cm (7.5") wide (x-axis) and 1.83 meters (72") long (y-axis), the distortion due to thermal expansion in the vertical direction is controlled to less than 5 mils.

Having thus provided a general discussion of the apparatus of the invention, described how the apparatus maintains the casting faces of opposed mold blocks in their respective reference planes, essentially without having to compensate for vertical thermal expansion of the mold block because such expansion has been minimized, described how excellent surface planarity of the cast slab is maintained during operation of the machine, and illustrated the invention with specific examples of the best mode of carrying out the invention, it will be evident that the invention has provided an effective solution to a difficult and persistent problem. It is therefore to be understood that no undue restrictions are to be imposed by reason of the specific embodiments illustrated and discussed, except as provided by the following claims.

We claim:

1. In a continuous block caster for casting molten metal in a moving mold cavity defined by opposed casting faces of mold blocks in mold block assemblies carried by carriage blocks in upper and lower casting trains of said block caster, wherein each of said mold block assemblies is mounted with plural mounting units to a carriage block, and each said mounting unit comprises a supporting means connected to a fastening means attached to said carriage block, the improvement comprising, each mold block of generally rectangular cross-section being made of a heat conductive metal, and provided in the fore and aft faces thereof, with plural, opposed longitudinal bores, in each of which a heat insulating anchor sheath is inserted; each said anchor sheath having an anchor pin snugly fitted therein; said mold block, in the non-casting face thereof, having plural vertical bores in transversely spaced apart relationship, each of said vertical bores being in open communication with a longitudinal bore; and, a sleeve of thermal insulation snugly fitted in each of said vertical bores.

2. The continuous block caster of claim 1 wherein each said mold block is provided with a rigid planar laminated heat shield mounted in vertically spaced apart relationship with the non-casting face of said mold block, said heat shield comprising a laminate of a metal sheet and a ceramic sheet, said ceramic sheet being nearer to the mold block than said metal sheet, said heat shield having passages therein, through which passages are inserted support pins of said support pin assemblies.

3. The continuous block caster of claim 2 wherein each said mold block assembly with said supporting means is independently demountably secured to said fastening means.

4. The continuous block caster of claim 2 including a flexible and expansible heat shield interconnecting said fore and aft faces of each said mold block to the faces of essentially contiguous mold blocks.

5. The continuous block caster of claim 3 wherein each said anchor pin is disposed within said mold block with the central transverse axis (in the direction of the y-axis) of said anchor pin lying between the casting face of said mold block and the transverse center line of said mold block.

6. In a continuous block caster for casting molten metal in a moving mold cavity defined by opposed casting faces of mold blocks in mold block assemblies carried by carriage blocks in upper and lower casting trains of said block caster, wherein each of said mold block assemblies is mounted with plural mounting units to a carriage block, and each said mounting unit comprises a supporting means connected to a fastening means attached to said carriage block, the improvement comprising, said supporting means comprising a support pin assembly connecting said mold block assembly to said fastening means, said support pin assembly comprising, an elongate support pin inserted through a centering stop, a lock-down plate, and a camming means, a proximal end of said support pin being insulatedly anchored in each said mold block, and distal end in which is secured a pilot, all operatively interconnected to mount and unmount said mold block assembly and supporting means from said fastening means.

7. The continuous block caster of claim 6 wherein said proximal end of each said support pin is threadedly secured within an insulated anchor in said mold block, and said distal end is demountably attached to said fastening member.

8. The continuous block caster of claim 7 wherein said camming means includes chamfered portions on said stepped lock-down key, and lower surfaces of said lock-down plate are adapted to engage said lock-down plate.

9. The continuous block caster of claim 8 wherein said lock-down plate has an aperture therein through which said lock-down key and said pilot are insertable.

10. In a continuous block caster for casting molten metal in a moving mold cavity defined by opposed casting faces of mold blocks in mold block assemblies carried by carriage blocks in upper and lower casting trains of said block caster, wherein each of said mold block assemblies is mounted with plural mounting units to a carriage block, and each said mounting unit comprises a supporting means connected to a fastening means attached to said carriage block, the improvement comprising, said fastening means include plural slide members and a single fixed fastening member, said fixed fastening member is fixedly secured to the center of said carriage block, and said slide members are secured to said carriage block on either side of said fixed fastening member, said slide members include a row of y-slides movable to-and-fro along the y-axis, and a row of x-y slides movable in the x-y plane, each row of said slides being interchangeably disposed in fore and aft rows above the transverse sides of the non-casting face of said mold block, and said fixed fastening member is centrally disposed in a row of y slides which are oppositely disposed relative to a row of x-y slides.

11. The continuous block caster of claim 10 wherein said molten metal is aluminum, said mold block is made of copper, said x-y slide is displaceable so that said support pin moves in a zone having a diameter of 10 mm, and the center line of said anchor pin is disposed closer to the casting face of said mold block than to the non-casting face thereof.

* * * * *